United States Patent [19]

Smith

[11] 4,332,523

[45] Jun. 1, 1982

[54] TURBINE SHROUD ASSEMBLY

[75] Inventor: Raymond Smith, Monclova, Ohio

[73] Assignee: Teledyne Industries, Inc., Los Angeles, Calif.

[21] Appl. No.: 42,331

[22] Filed: May 25, 1979

[51] Int. Cl.[3] ..... F04D 29/08

[52] U.S. Cl. ..... 415/126; 415/172 A

[58] Field of Search ..... 415/127, 138, 113, 180, 415/47, 174, 136, 170 R, 172 R, 172 A, 173 R, 173 A, 12, 136, 138, 134, 135, 126

[56] References Cited

U.S. PATENT DOCUMENTS

| | | | |
|---|---|---|---|
| 3,146,992 | 9/1964 | Farrell | 415/12 |
| 3,185,441 | 5/1965 | Reuter | 416/182 |
| 3,227,418 | 1/1966 | West | 415/127 |
| 3,876,330 | 5/1975 | Pearson | 415/174 |
| 3,970,318 | 7/1976 | Tuley | 415/172 |
| 3,986,720 | 10/1976 | Knuden et al. | 415/136 |
| 4,050,843 | 9/1977 | Needham | 415/136 |
| 4,127,357 | 11/1978 | Patterson | 415/138 |

*Primary Examiner*—Louis J. Casaregola
*Attorney, Agent, or Firm*—Gifford, VanOphem, Sheridan & Sprinkle

[57] ABSTRACT

A turbine shroud assembly is provided for use in conjunction with a turbine engine having a turbine rotor consisting of a disc and plurality of blades attached to and extending radially outwardly from the disc wherein the outer tips of the blades are axially tapered at a predetermined angle. The shroud assembly comprises an annular shroud positioned around the turbine blades and tapered axially at the predetermined angle such that the shroud is evenly spaced radially outwardly from the turbine blades. A plurality of circumferentially spaced bell crank assemblies attach the shroud to a turbine support housing and, in response to thermal expansion of the shroud, axially shift the shroud in a direction to decrease the clearance between the shroud and the turbine blade tips.

17 Claims, 5 Drawing Figures

TURBINE SHROUD ASSEMBLY

BACKGROUND OF THE INVENTION

I. Field of the Invention

The present invention relates generally to shroud assemblies for turbine engines and, more particularly, to such a shroud assembly with means for maintaining tip clearance for the turbine blades over the engine operating temperature range.

II. Description of the Prior Art

Historically, improvements in turbine engine performance have been heretofore achieved by increases in the gas temperature at the turbine inlet. Current projections anticipate a continuing increase in the operating temperatures for the turbine while maintaining or even improving component efficiencies and the overall efficiency of the engine.

High turbine engine efficiency requires a minimization of the turbine rotor tip clearance, i.e. the clearance between the outer radial ends of the turbine blades and the turbine rotor shroud over the operating temperature range of the engine. Due to the thermal expansion of the turbine disc, the turbine blades and the shroud, turbine rotor tip clearance control and minimization becomes increasingly difficult as the turbine inlet temperatures increase.

With the previously known turbine engines, the rotor tip clearance is preset to a predetermined value, for example 0.05 inches for a 6.3 inch radius turbine rotor when the engine, and consequently the engine components, are cold. During rapid engine start and acceleration, both the engine shroud and turbine blades rapidly reach their operating temperatures and, as a result, thermally expand. The thermal expansion of the shroud, however, exceeds that of the turbine blades so that the rotor clearance increases to, for example, 0.12 inches in the given example at engine start up.

As the turbine reaches a steady state operation, the disc in addition to the shroud and blades also reaches its operating temperature thus reducing the rotor tip clearance to, for example, 0.06 inches for the given example. This relatively wide rotor tip clearance at the steady state operating condition for the turbine engine substantially adversely affects the overall turbine engine efficiency.

During a throttle chop, i.e. when the turbine engine is rapidly shut down, both the shroud and turbine blades rapidly cool and thus thermally contact. The turbine disc, however, retains its heat for a relatively longer period of time and thus remains in a state of thermal expansion of, for example 0.04 inches for the 6.3 inch radius turbine rotor. It is this thermal expansion of the disc which establishes the assembly tip clearance requirement in order to prevent siezure of the turbine during engine shut down.

There are a number of previously known methods designed to reduce the rotor operating tip clearance, and thereby increase engine efficiency, during operation of the turbine engine. These previously known methods include segmenting the shroud and supporting the shroud from relatively cool rails. Similarly, an increase in the cooling air flow across the shroud has been used to decrease the thermal expansion of the shroud and thus decrease the rotor tip clearance. These previously known methods, however, each have their own undesirable characteristics and, therefore, are only partially effective in operation.

SUMMARY OF THE PRESENT INVENTION

The present invention overcomes these previously known undesirable characteristics and will, therefore, further improve engine efficiencies by providing a unique shroud assembly which axially shifts in response to thermal expansion of the shroud in order to reduce rotor tip clearance during turbine engine operation.

In brief, the shroud assembly according to the present invention comprises an annular shroud positioned around the turbine blades and axially tapered at a predetermined angle. The tips of the turbine blades are likewise tapered at the same angle so that they are evenly spaced from the shroud along the axial length of the shroud.

The shroud, in turn, is mounted to the turbine engine housing by means of a plurality of circumferentially spaced bell cranks. Each bell crank is pivotally mounted about an axis tangential to but radially spaced from the shroud and has a radially outwardly extending first arm which engages a socket formed in the outer periphery of the shroud. The bell crank includes a second radially outwardly extending arm, angularly spaced from the first, which abuts against the outer periphery of the shroud.

In operation, thermal expansion of the shroud forces the second arm of the bell crank radially outwardly thus pivoting or rotating the bell cranks. This pivotal action of the bell cranks axially shifts the shroud via the first arms of the bell crank toward the turbine blade tips to thereby reduce the rotor tip clearance.

Suitable resilient means, such as a leaf spring, are connected between the turbine engine housing and each bell crank and urge the bell cranks with the attached shroud away from the turbine blades when the shroud is relatively cool. In this fashion, the resilient means axially retracts the shroud in a direction to increase the tip clearance between the shroud and the turbine blades to prevent interference between the shroud and the turbine blades during engine shutdown. The axial motion of the shroud is continuous over the operating range of the engine, from start to maximum temperature and shutdown. The axial position of the shroud is a function of shroud temperature and will always position itself to minimize the tip clearance over the full operating (temperature) range of the engine, thereby improving engine efficiencies at part power as well as maximum power (maximum temperature).

BRIEF DESCRIPTION OF THE DRAWINGS

A better understanding of the present invention will be had upon reference to the following detailed description when read in conjunction with the accompanying drawings wherein like reference characters refer to like parts throughout the several views, and in which.

DETAILED DESCRIPTION OF THE PRESENT INVENTION

Figure 1:
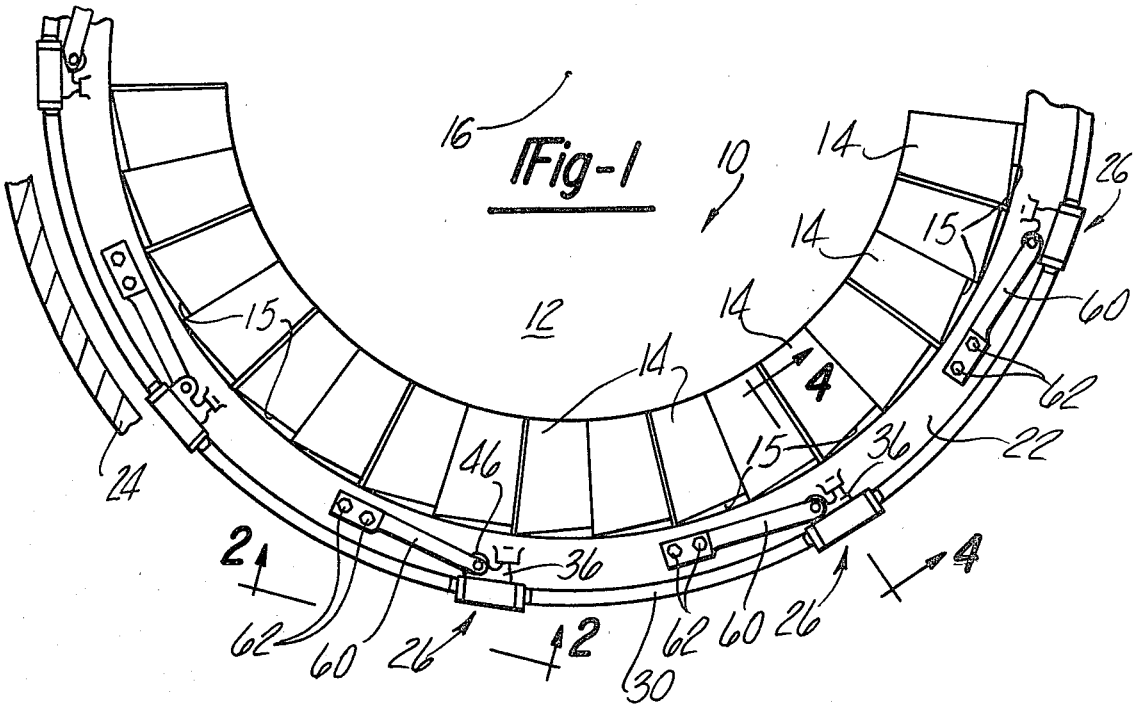
FIG. 1 is a fragmentary axial plan view showing the shroud assembly according to the present invention and with parts removed for clarity.

With reference first to FIG. 1, a turbine engine rotor 10 is thereshown comprising a disc 12 and a plurality of turbine blades 14 secured to and extending radially outwardly from the disc 12. The rotor 10 forms part of a turbine engine having a support housing 24 illustrated diagrammatically. The disc 12 with the attached turbine blades 14 is rotatably journalled in the housing 24 and is adapted to rotate at high speed about a predetermined axis 16 of rotation. The tip 15 of each rotor blade 14 is axially tapered at a predetermined angle $\alpha$ (FIG. 3) for a reason to be subsequently described.

Figure 2:
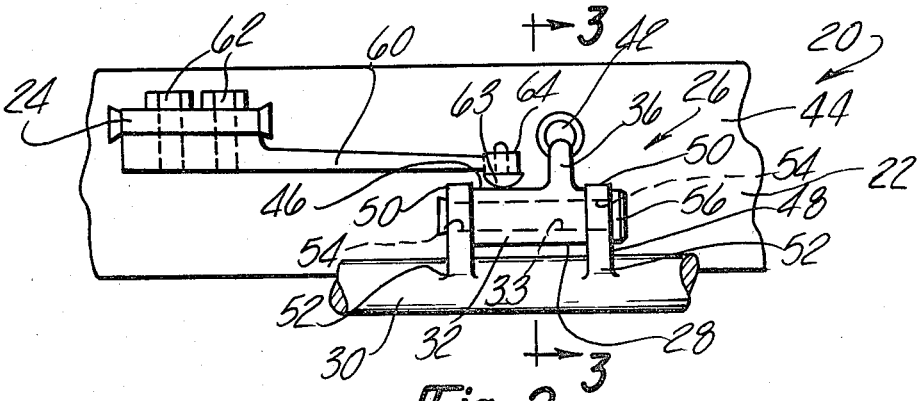
FIG. 2 is a fragmentary radial plan view taken substantially along line 2—2 in FIG. 1 and enlarged for clarity.
Figure 3:
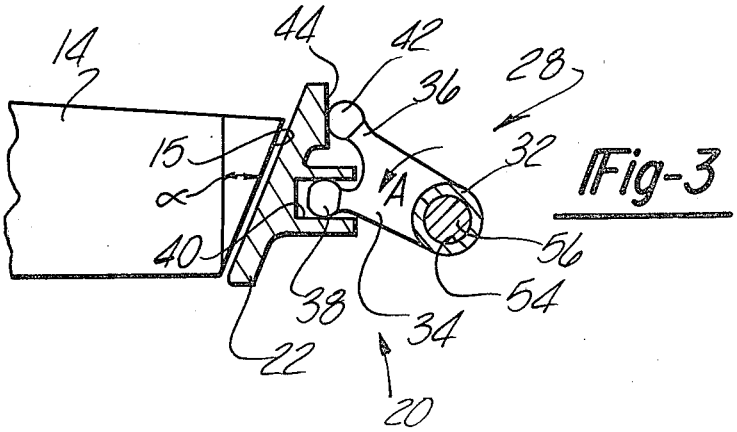
FIG. 3 is a fragmentary sectional view taken along line 3—3 in FIG. 2 and with parts removed for clarity.
Figure 4:
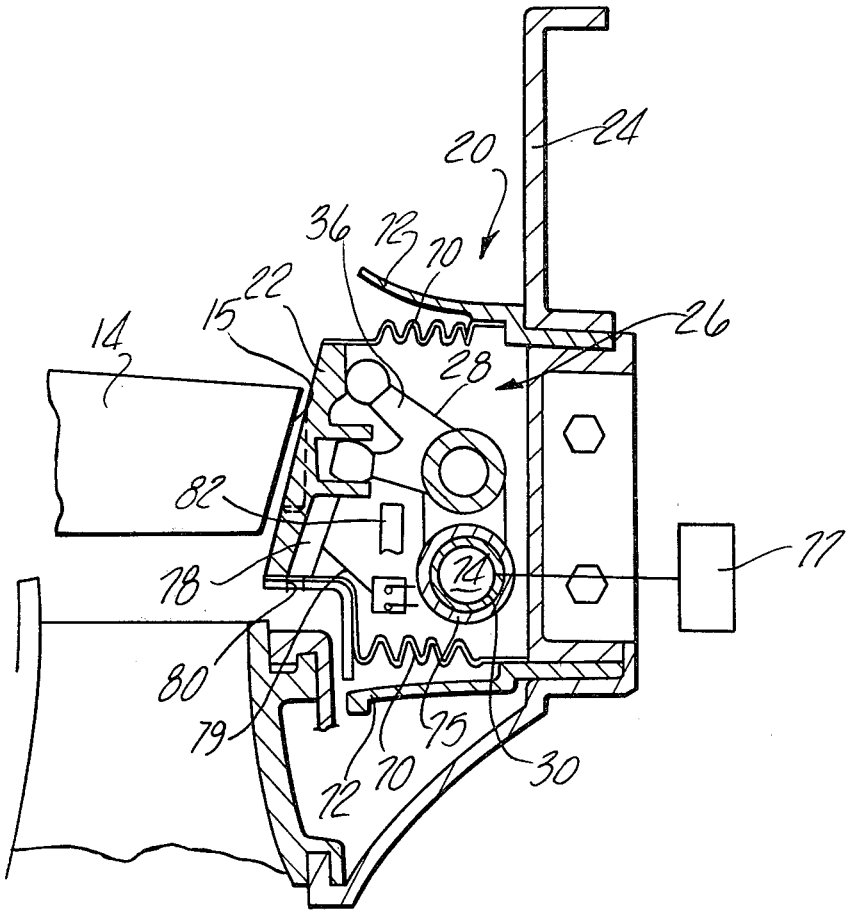
FIG. 4 is a fragmentary sectional view taken substantially along line 4—4 in FIG. 1 and enlarged for clarity.

With reference now to FIGS. 1–4, the shroud assembly 20 according to the present invention comprises an annular shroud 22 positioned coaxially around and spaced slightly radially outwardly from the turbine blade tips 15. The shroud 22, which is secured to the turbine engine support housing 24 in a manner which will be subsequently described in greater detail, axially tapers at substantially the angle $\alpha$ as best shown in FIGS. 3 and 4. With this arrangement, the spacing or clearance between the tips 15 of the turbine blades 14 and the shroud 22 is substantially the same along the axial length of the shroud 22. It is the minimization of the clearance between the shroud 22 and the tips 15 of the turbine blades 14 which maximizes engine efficiency.

Referring to FIG. 1 the shroud 22 is supported by and secured to the support housing 24 by means of a plurality of circumferentially spaced bell crank assemblies 26. As can best be seen in FIG. 2 each bell crank assembly 26 comprises a bell crank 28 and means for pivotally mounting the bell crank 28 to a bell crank support ring 30 positioned coaxially around and spaced radially outwardly from the shroud 22. The support ring 30 is stationarily secured by pins (not shown) to the support housing 24.

With reference to FIGS. 2 and 3, each bell crank 28 comprises a cylindrical portion 32 with a throughbore 33 and a first radial arm 34 and a second radial arm 36 extend outwardly from the portion 32. The arms 34 and 36 are in substantially the same radial plane but are angularly spaced from each other.

A ball 38 at the free end of the first arm 34 is received within a socket 40 formed on the outer periphery of the shroud 22 while a second ball 42 at the free end of the second arm 36 engages an abutment surface 44 formed on the outer periphery and at one axial end of the shroud 22. As can best be seen in FIG. 1, the bell crank 28 includes a further radial protruding portion 46 which is axially spaced from the plane of the arms 34 and 36.

As can best be seen in FIG. 2, a pair of spaced supports 50 are secured at one end 52 to the support ring 30 and form a clevis between which the bell crank cylindrical portion 32 is positioned. Each support 50 has a throughbore 54 which registers with the bell crank throughbore 33. A pin 56 extends through and pivotally mounts the bell crank portion 32 to the supports 50 for a reason which will become hereinafter shortly apparent. In addition, the pivotal axis for the bell crank 28 is substantially tangential to but spaced radially outwardly from the shroud 22.

With reference to FIGS. 1 and 2, a leaf spring 60 is secured at one end to the engine support housing 24 by fasteners 62. A spherical button 63 is attached to the other end 64 of the leaf spring 60 and abuts against the radially protruding portion 46 from the bell crank 28. The leaf spring 60 resiliently urges the bell crank 28 in a counterclockwise rotational direction as shown in FIG. 3 by the arrow A. The torque produced by the spring 60 acting on the bell crank 28 keeps the ball end 42 at the end of the second arm 36 in contact with the abutment surface 44 on the outer perimeter of the shroud 22.

With reference now particularly to FIG. 4, the bell crank assembly 26 is thereshown mounted within the engine support housing 24. A bellows 70 with bellows supports 72 provides both radial and axial tolerances between the shroud 22 and the support housing 24 and also prevents air leakage across the shroud. The bellows support 72 limits the axial travel of the bellows 70. In addition, a cooling air flow is preferably directed by means 77 to the interior 74 of the support ring 30 and the ring 30 is insulated at 75 to prevent or limit its thermal expansion. Additional cooling air flow 79 is also preferably directed by an impingement liner 78 against the shroud 22 to cool the shroud for engine designs where the temperatures are high enough to require cooling. Fluid passage means 80 permit the cooling air flow against the shroud 22 to exit into the gas flow stream for expulsion from the engine.

Figure 5:
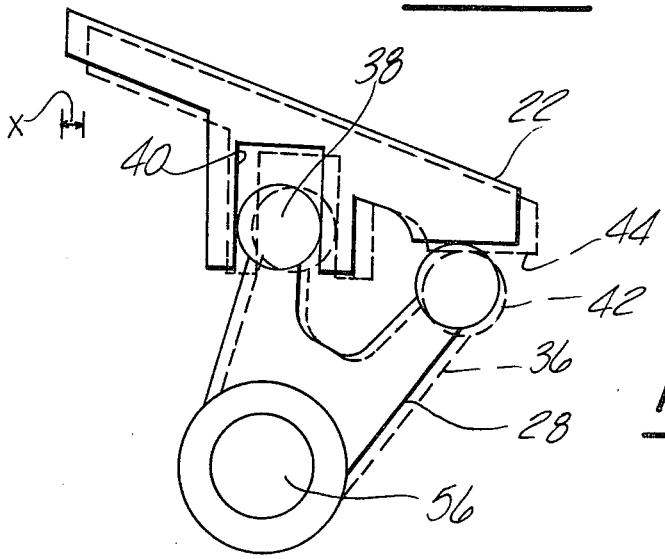
FIG. 5 is a diagrammatic view similar to FIG. 3 but enlarged and depicting the operation of the shroud assembly according to the present invention.

With reference to FIG. 5, the operation of the present invention will now be described. When the engine shroud 22 is relatively cool, for example, prior to engine start up or after engine shutdown, the leaf spring 60 urges the bell crank 28 in a counterclockwise direction about the pin 56 and toward the stop 82. The position of the shroud 22 when relatively cool is depicted in solid line in FIG. 5.

At engine start up, during acceleration or at steady-state operation, the shroud 22 rapidly heats up and thermally expands radially outwardly. Due to the abutment between the abutment surface 44 on the shroud 22 and the ball 42 at the free end of the bell crank arm 36, the thermal expansion of the shroud 22 forces the bell crank 28 to pivot in a clockwise direction about the pin 56 to the position shown in phantom line in FIG. 5. This clockwise rotation of the bell crank 28 about the pin 56 in turn axially shifts the shroud 22 a distance "X", due to the engagement of the ball 38 in the socket 40 toward the tapered tips 15 of the turbine blades 14. The axial displacement of the shroud 22, in effect, reduces the increase in tip clearance caused by the thermal expansion of the shroud 22 during engine start up, acceleration and steady-state operation by an amount equal to "X" multiplied by the sine $\alpha$. As the shroud 22 cools, the leaf spring 60 returns the bell crank 28, and thus the shroud 22, to the counterclockwise position shown in solid line in FIG. 5 to minimize the tip clearance at engine start up.

It can, therefore, be seen that the shroud assembly according to the present invention provides a novel and unique means for reducing tip clearance during start up, acceleration and steady-state operation of the turbine engine. By the reduction in tip clearance the present invention simply, but effectively, increases the turbine engine efficiency.

It will also be understood that while the shroud assembly of the present invention has been described for use with an airfoil having blades in which the outer tips of the blades axially taper at an angle, other blade tip and shroud configurations can also be employed while remaining within the scope of the invention.

Having described my invention, however, many modifications thereto will become apparent to those skilled in the art to which it pertains without deviation from the spirit of the invention as defined by the scope of the appended claims.

I claim:

1. A shroud assembly for use with an airfoil rotatably mounted in a housing, said shroud assembly comprising:

an annular shroud, the inner periphery of said shroud conforming to the outer periphery of the airfoil;

means for mounting said shroud to the housing coaxially around the spaced radially outwardly from the airfoil whereby a clearance is provided between the shroud and the airfoil; and said mounting means comprising bell crank means pivotally mounted to said housing and responsive to thermal expansion of the shroud for moving said shroud in a first direction toward said airfoil to thereby reduce the clearance between said shroud and said airfoil.

2. The invention as defined in claim 1 wherein both the inner periphery of the shroud and the outer periphery of the airfoil are axially tapered at substantially the same angle and wherein said moving means axially moves said shroud.

3. The invention as defined in claim 1 wherein said bell crank means comprises at least one bell crank pivotally mounted to the housing and means connecting said shroud to said bell crank.

4. The invention as defined in claim 3 wherein said connecting means comprises an arm extending radially outwardly from the bell crank and abutting against the outer periphery of the shroud at the free end of the arm.

5. The invention as defined in claim 3 wherein said connecting means comprises an arm extending radially outwardly from the bell crank and a socket formed on the outer periphery of the shroud in which the free end of the arm is received.

6. The invention as defined in claim 3 and further comprising a plurality of bell cranks circumferentially spaced around said shroud.

7. The invention as defined in claim 6 and further comprising a bell crank support ring positioned coaxially around said shroud, and means for securing said ring to the housing, wherein said bell cranks are pivotally mounted to said support ring.

8. The invention as defined in claim 7 and including means for cooling said support ring.

9. The invention as defined in claim 8 wherein said support ring is hollow and wherein said cooling means comprises means for establishing a fluid flow through said ring.

10. The invention as defined in claim 7 and including means for thermally insulating said ring.

11. The invention as defined in claim 1 and including resilient means for urging said shroud in a direction opposite from said first direction.

12. The invention as defined in claim 11 wherein said resilient means comprises a spring secured at one end to the housing and engaging the mounting means at the other end.

13. A shroud assembly for use in conjunction with an airfoil having a plurality of blades attached to and extending radially outwardly therefrom, said airfoil being rotatably mounted in a housing, the radially outer tips of said blades being axially tapered at a predetermined angle, said shroud assembly comprising:

an annular shroud;

means for mounting said shroud to the housing coaxially around but spaced radially outwardly from said airfoil blades, said shroud being axially tapered at substantially said predetermined angle whereby said shroud is substantially evenly spaced from the tips of the airfoil blades; and means responsive to the thermal expansion of said shroud for axially moving said shroud in a first direction to reduce the distance between said shroud and said airfoil blades, said moving means comprising at least one bell crank member pivotally mounted to the housing about an axis substantially tangential with respect to the airfoil axis, said member having a radially outwardly extending arm which engages a recess in said shroud whereby rotation in one direction of said member axially shifts said shroud in the first direction.

14. The invention as defined in claim 13 and including resilient means for axially urging said shroud in a second direction opposite from said first direction.

15. The invention as defined in claim 13 wherein said member includes a second radially outwardly extending arm angularly spaced from said first arm, wherein said second arm abuts against a surface on the outer periphery of said shroud so that radial thermal expansion of the shroud rotates said member via said second arm.

16. The invention as defined in claim 13 and further comprising a support ring secured to the housing coaxially around said shroud, at least one pair of spaced support members secured to and extending outwardly from said ring, said support members forming a clevis between which said pivotally mounted member is secured.

17. The invention as defined in claim 13 and further comprising a spring secured at one end to the housing and secured at its other end to a protruding portion on said pivoting mounted member, said spring being biased to urge the pivotally mounted member in a rotational direction opposite from said first direction.

* * * * *

UNITED STATES PATENT AND TRADEMARK OFFICE

CERTIFICATE OF CORRECTION

PATENT NO. : 4,332,523
DATED : June 1, 1982
INVENTOR(S) : Raymond Smith

It is certified that error appears in the above—identified patent and that said Letters Patent is hereby corrected as shown below:

Column 1, line 57, delete "siezure", insert --seizure--

Signed and Sealed this

*Twenty-sixth* Day of *October 1982*

[SEAL]

*Attest:*

GERALD J. MOSSINGHOFF

*Attesting Officer* *Commissioner of Patents and Trademarks*